United States Patent [19]

Snow, Jr.

[11] Patent Number: 4,885,807

[45] Date of Patent: Dec. 12, 1989

[54] QUICK RELEASE FACE MASK FOR USE WITH CONTACT SPORTS HELMETS

[76] Inventor: Paul D. Snow, Jr., 608 Vermont Ave., Ft. Walton Beach, Fla. 32548

[21] Appl. No.: 71,419

[22] Filed: Jul. 9, 1987

[51] Int. Cl.[4] ..... A42B 3/02

[52] U.S. Cl. ..... 2/424; 2/425

[58] Field of Search ..... 2/9, 171.4, 173, 206, 2/424, 425

[56] References Cited

U.S. PATENT DOCUMENTS

| | | | |
|---|---|---|---|
| 2,986,739 | 6/1961 | Rozzi, Sr. | 2/9 |
| 3,282,336 | 11/1966 | Critser | 2/9 |
| 3,858,242 | 1/1975 | Gooding | 2/424 X |
| 3,889,296 | 6/1975 | Martin | 2/9 |
| 4,233,687 | 11/1980 | Lancellotti | 2/425 X |
| 4,271,537 | 6/1981 | Bowlus et al. | 2/424 |
| 4,335,472 | 6/1982 | Rappleyea | 2/425 X |
| 4,363,240 | 12/1982 | Correale | 2/9 |
| 4,495,657 | 1/1985 | Bay | 2/424 X |
| 4,748,696 | 6/1988 | Fohl | 2/424 |

FOREIGN PATENT DOCUMENTS

| | | | |
|---|---|---|---|
| 517411 | 11/1986 | Fed. Rep. of Germany | 2/425 |
| 2338005 | 8/1977 | France | 2/424 |

*Primary Examiner*—Wm. Carter Reynolds

*Attorney, Agent, or Firm*—Pravel, Gambrell, Hewitt, Kimball & Krieger

[57] ABSTRACT

A face mask release apparatus for a contact sports helmet includes a face mask having a three point attachment to the left and right respective side portions of the helmet and to the forward forehead area of the helmet. The attachment includes a plurality of posts, positioned in pairs on each respective side of the helmet in the temple areas and a ball and socket connection in the forehead area. Each post includes a grooved area formed around the post defining a narrowed diameter section and a bracket carried at the ends of each side of the face mask forms a releasable connection with the posts in virtually all directions away from the helmet and along the helmet so that the user is protected from head and neck injury when force is applied to the mask in any of one of a plurality of directions.

3 Claims, 3 Drawing Sheets

QUICK RELEASE FACE MASK FOR USE WITH CONTACT SPORTS HELMETS

BACKGROUND OF THE INVENTION

1. Field of the Invention:

The present invention relates to quick release face masks for use with contact sports helmets, such as football helmets. Even more particularly, the present invention relates to an improved quick release face mask for use with football helmets and the like wherein the face mask releases from the helmet not withstanding the direction of force applied to the helmet during contact.

2. General Background:

American football is one of the most popular of contact sports. Football players wear a commonly seen rounded helmet in addition to pads which protect the shoulders, hip, legs and torso areas. The helmet is typically a one-piece rounded hollow shell of plastic having a bottom opening which allows insertion of the player's head into the helmet interior. The helmet is usually held on the player's head by means of a chin strap which buckles at its ends to the temple areas of the helmet, corresponding to a position on the player's head adjacent the temple area or the rear jaw area. While the helmet provides protection for the sides, top and rear of the player's head, the helmet leaves an exposed forward area, namely, the player's face.

In the earliest history of football, players typically received injuries to the facial area, including broken noses, gouged eyes, shattered teeth, and the like because the facial area was largely unprotected. This practice of not protecting the facial area started when helmets were made of leather in the early 1900's, but continued even after plastic helmets became available. In the middle of the 20th century, players began to use a single bar across the front of the helmet extending away from the player's face and attaching to the temple portions of the helmet. The bar was generally U-shaped extending forward of the player's mouth area. In the 1950's a double bar face guard began to be used. Unfortunately, even the double bar did not fully protect the player's face area from being smashed by an opposer's fist in that the eyes and nose were fully exposed. In the 1960's and 70's, face masks became more sophisticated and involved a grid-like "cage" that completely covered the player's facial area offering protection to the eyes, nose, mouth, teeth and jaw. The "cage" typically extended from the forehead portion of the helmet downwardly and extended well below the player's chin until it virtually touched the chest area of the player. The "cage" also used a network of horizontal and vertical bars forming a grid to fully protect the player's face from damage while still affording sufficient visibility to the player. Unfortunately, the grid provided on the mask also provides an excellent surface that could be gripped by an opposing player, even if at times inadvertently. Thus, many players have been injured, and some very seriously, sometime resulting in death when the face mask is grabbed by an opposing player's hand and the head ripped violently and quickly in a direction different from the direction the player is running. Because the "cage" or face mask is rigidly attached to the helmet and because the helmet is rigidly affixed with a chin strap to the player's head, a great amount of force can be unfortunately transmitted to the player's neck and spine through the hand of an opposing player.

Various attempts have been made to solve the problem of serious injury and even death to football players by providing for a release of the face guard or face mask from the helmet when force is applied to the helmet during contact.

An early U.S. Pat. No. 3,139,624, entitled "Face Guard For Football Helmet," was issued to Delby Humphrey. The Humphrey patent describes the hazards of a face mask as forming a ready hand hold during contact by an opponent grasping the face mask and pulling on the face mask so that the helmet rotates about the chin strap. In the Humphrey patent, a releasable connection is provided at the temple areas of the helmet between the helmet and the face mask. A pivotal connection is formed between the face mask and the forehead area while clamps secure the helmet at the sides or temple areas. The Humphrey device is primarily directed to a releasing of the face guard from the football helmet when a forward pulling is applied to the face mask with respect to the wearer's head.

Another Humphrey patent, U.S. Pat. No. 3,263,236, entitled "Mounting For Face Mask," uses four clamps, namely, a pair of clamps at the temple area and a pair of clamps in the forehead area for securing a face mask to the helmet. Upon the application of stress to the face guard beyond an allowable limit, the guard would snap free from the clamp holders, or break the clamp holders, thus to protect the helmet and the face guard as well as the individual wearing the helmet. The Humphrey '236 patent likewise is directed to a structure that would not readily release if pressure was applied from a sideways direction.

A single directional sliding, releasable connection between a face guard and a helmet is seen in the Bednarczuk, et al patent, U.S. Pat. No. 3,815,152, entitled "Safety Football Helmet." A similar single directional releasing face mask is seen in U.S. Pat. No. 3,897,598, also naming Bednarczuk, et al as inventors.

The Humphrey U.S. Pat. No. 3,729,746, entitled "Arrangement For Connecting A Face Guard To A Helmet," discloses a connector arrangement for pivotally connecting a face guard to a helmet at the lower front edge of the helmet so that the face guard can swing in the fore and aft direction while strap elements are provided connecting the face guard to the helmet at the sides of the helmet, and normally preventing the aforementioned fore and aft movement. The side connector elements are somewhat resilient and can be cut with a knife to permit the face guard to be swung away from the player's face in case it is necessary to give the player emergency treatment.

A tear-away face mask subassembly is the subject of U.S. Pat. No. 3,889,296. The Martin reference is similar to the Bednarczuk patents above-described in that force must be applied in a direction away from the player's face in order to pull the face mask release and thus it suffers from a failure to release quickly is force if applied from the side.

The Lancellotti U.S. Pat. No. 4,233,687, entitled "Sports Helmet With Face Mask," uses a plurality of face clamps to hold a face mask to a helmet. The mask shown is of grid like configuration having a peripheral base portion that is attached to the helmet. In one embodiment, the attachment includes a plurality of spaced blocks each including a forwardly directed undercut opening for receiving the base portion of the mask. In another embodiment, the attachment includes an element secured to the mask about the periphery of the frontal opening thereof such that the base portions of the mask may be disposed proximal thereto. In the latter embodiment, the attachment of the mask to the helmet is by means of a plurality of headed members received within recessed pockets. The pockets may be formed either in the base portion of the mask or in the peripheral element of the helmet. In all cases, the mask is received by the helmet in a snap frictional engagement such that the mask may be completely removed therefrom, i.e., broken away when strenuously grasped by an opponent during athletic play so as to reduce the likelihood of twist-type injury to the neck or head of the wearer. The Lancellotti reference functions primarily when force is applied in a forwardly direction in that the attachments of the mask to the helmet are confining in a lateral direction so that quick release might be difficult or impossible if a pull were made in a sideways direction, the direction which can cause in some cases the worst type of twisting injury to the neck and spine.

Other guards designed to release from a football helmet, primarily in a uni-directional, forwardly direction, include U.S. Pat. No. 4,271,537, issued to Burton R. Bowles, et al, entitled "Protective Helmet With Releasable Face Guard Apparatus," and the Correale U.S. Pat. No. 4,363,140, entitled "Football Helmet Face Guard." The Butash U.S. Pat. No. 4,594,737, entitled "Football Helmet Face Mask," attempts to solve the problem of injury to the player by making it difficult for the player to grab an opposing player's face mask by forming a wire frame for the face mask covered with a series of beads that are strung along certain wires to make it difficult for an opposing player to grab the face mask. However, if a player does in fact grab the Butash face mask, injury could result as a quick release multi-directional release is not provided therein.

The present invention solves these prior art problems and shortcomings by providing an improved football or like contact sports helmet and face mask apparatus having the quick release feature even when the player's face mask is pulled from a sideways direction. This apparatus would help prevent suffering of severe brain damage or neck injury including paralysis or death. Thus, the present invention provides a multi-directional quick release face mask which provides quick release between the face mask and the helmet when high stress is transmitted thereto yet a structural connection is formed between the face mask and helmet during normal play. The apparatus has utility for football helmets and may be used for other types of helmets.

A feature of the present invention is the ability to easily load the connection between the mask and the helmet with a predetermined release value so that a higher value could be used for more experienced, better conditioned players, such as college and professional athletes, while a lower release load value could be used for less experienced, younger players such as high school, junior high and elementary ages.

The present invention provides a face mask having a three-point attachment with three attachment portions including left and right side attachments, each adapted for placement at the left and right temple areas of the helmet and a central upper attachment generally between the left and right side attachments and adapted for attachment to the center forehead area of the helmet. A plurality of preferably cylindrical posts are positioned on each side of the helmet in the temple area preferably arranged in pairs, each cylindrical post having a central axis generally perpendicular to the helmet's outer surface and including a first pair of closely spaced posts placed on the left side of the helmet and a corresponding pair of closely spaced posts on the right side of the helmet. A grooved area is formed on each post defining a narrowed diameter section of each post generally between the end portions leaving an enlarged outer end portion of each post that functions with the groove as a retainer to hold the face mask to the helmet. Brackets are provided on the left and right rear ends of the face mask for forming a quick release connection of the face mask to the helmet at the posts. The bracket and post connection allows removal of the mask from the posts responsive to the application of force to the mask, as during contact sports, from one or more directions including at least force which moves the mask end portion away from the post in a lateral direction, away from the helmet, and generally along the central axis of the post. Quick release also occurs when force is applied in a direction which moves the mask in a direction away from the post in a direction along the helmet and at generally angles with respect to the post.

Thus, the present invention provides a quick release face mask apparatus which will readily release the mask from the helmet no matter in what direction force is applied to the mask by an opposing player's hand. The mask can be a wire grid-like mask covered with plastic, for example, or entirely plastic while the posts can be of a resilient material such as hard rubber or plastic. One skilled in the art will recognize that a desired load value for release can be provided by adjusting the durometer of the particular rubber or plastic used, or by changing the groove configuration so that greater or lesser confinement of the mask by the groove is achieved.

BRIEF DESCRIPTION OF THE DRAWINGS

A better understanding of the invention can be had when the detailed description of a preferred embodiment set forth below is considered in conjunction with the drawings, in which.

DETAILED DESCRIPTION OF THE PREFERRED EMBODIMENT

Figure 1:
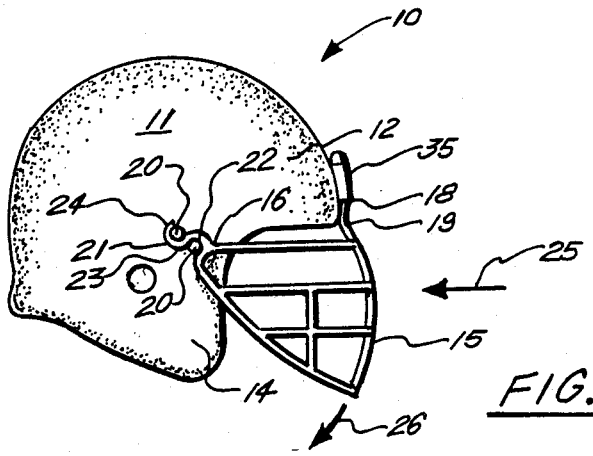
FIG. 1 is a side perspective view of one embodiment of the apparatus of the present invention.
Figure 2:
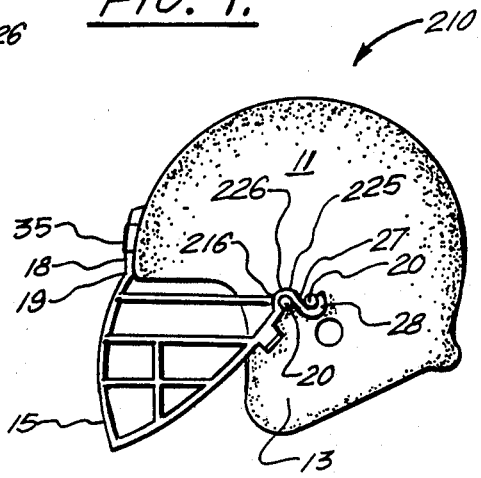
FIG. 2 is a side view of another embodiment of the apparatus of the present invention.
Figure 3:
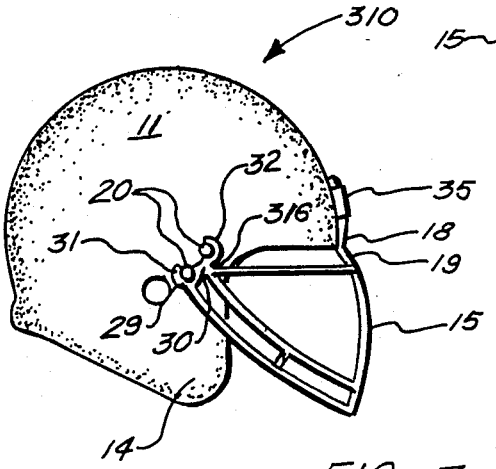
FIG. 3 is a side view of a third embodiment of the apparatus of the present invention.

In FIG. 1, there can be seen the preferred embodiment of the apparatus of the present invention designated generally by the numeral 10. FIG. 2 is a side view of apparatus 210 and FIG. 3 is a side view of apparatus 310. Face mask release apparatus 10 can be used, for example, with a rounded contact sports helmet 11 which has forehead 12 and left 13 and right 14 temple areas. A face mask 15 in the form of a grid-like cage includes left and right side portion 16 and a central attachment 18. Thus, a three point attachment is defined for affixing the mask 15 to the helmet 11, as shown generally in FIGS. 1–3. Each side 13, 14 of helmet 11 provides a plurality of posts, preferably arranged in closely spaced pairs, which are placed on the helmet in various configurations, as shown in FIGS. 1, 2 and 3. In FIG. 1, the right temple area 14 of the helmet 11 bears a pair of posts 20 which are spaced apart and define a line which forms a 45° angle with horizontal if the line connects the two posts. In FIG. 2, the two posts 20 are shown on the left temple area 13 of helmet 11, and in the embodiment of FIG. 2, the posts 20 are arranged along a line which is horizontal.

In FIG. 3, the posts 20 are likewise arranged in an angular position with respect to horizontal, preferably 45° with respect to horizontal, however, in FIG. 3, the rear post is in a lower position, whereas in FIG. 1, the rear post is in a high position.

In each embodiment of FIGS. 1, 2 and 3, the left and right connection 16, 216, 316 portions of masks 15, 215, 315 are provided with brackets which register with and form connections to the pair of spaced apart posts 20, as shown in the drawings. In FIG. 1, bracket 21 is generally S-shaped and could be, for example, manufactured of a rounded cross-section which corresponds to a narrowed grooved area of each post, as will be described more fully hereinafter. The bracket 21 includes a first portion 22 which wraps around the top side of posts 20, a central section 23 which passes between the posts 20 in FIG. 1, and a portion 24 which extends around the rear upper posts in FIG. 1 to form the "S" pattern as shown. One skilled in the art will recognize that the force applied to mask 15 in a direction, as shown by Arrow 25, namely, a forwardly application of force as would normally occur, results in a retention of the mask to the helmet as is desirable. However, force applied in either direction along the line indicated by the force Arrow 26, or in a sideways direction, perpendicular to the force Arrow 26, will cause the bracket 21 to rotate off the posts 20 because the posts 20 would be manufactured of a slightly flexible but resilient material, such as hard rubber, plastic, or the like (see FIGS. 8 and 9). In the configuration of FIG. 2, the end connections 217 are connected to brackets 225 which include a first portion 226 that wraps around the top of the forwardly position of posts 20, a central section 27 which passes between the posts 20 and a rear section 28 which wraps under the rearmost of the posts 20.

In FIG. 3, the mask 315 provides bracket 29 that are generally C-shaped and affixed to the ends 316 of face mask 315 with a first portion 30 that extends along the forward edges of posts 20 and a bottommost portion 31 that wraps around the underside of the lower posts 20, shown in FIG. 3, while a third portion 32 of the bracket 29 extends around the upper and forward portion of the uppermost posts 20, as shown in FIG. 3.

Figure 4:
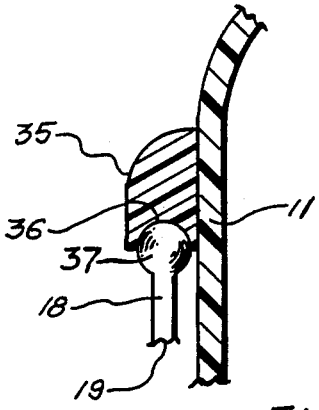
FIG. 4 is a fragmentary sectional view of the preferred embodiment of the apparatus of the present invention.
Figure 4A:
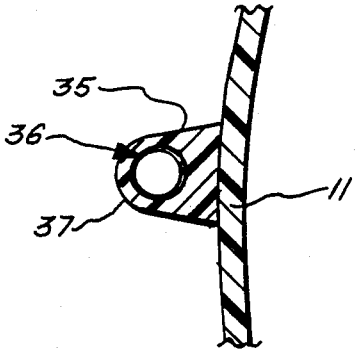
FIG. 4A is a fragmentary sectional horizontal view of the preferred embodiment of the apparatus of the present invention.

The connection between mask 15 and the forehead 12 portion of helmet 11 includes a center post 19 provided on mask 15 which interlocks with a forehead support bracket 35 mounted on the foreward or forehead area 12 of helmet 11, as shown in FIG. 1. Bracket 35 would preferably have a socket 36 receptive of ball 37, as best shown in FIGS. 4 and 4A.

Figure 10A:
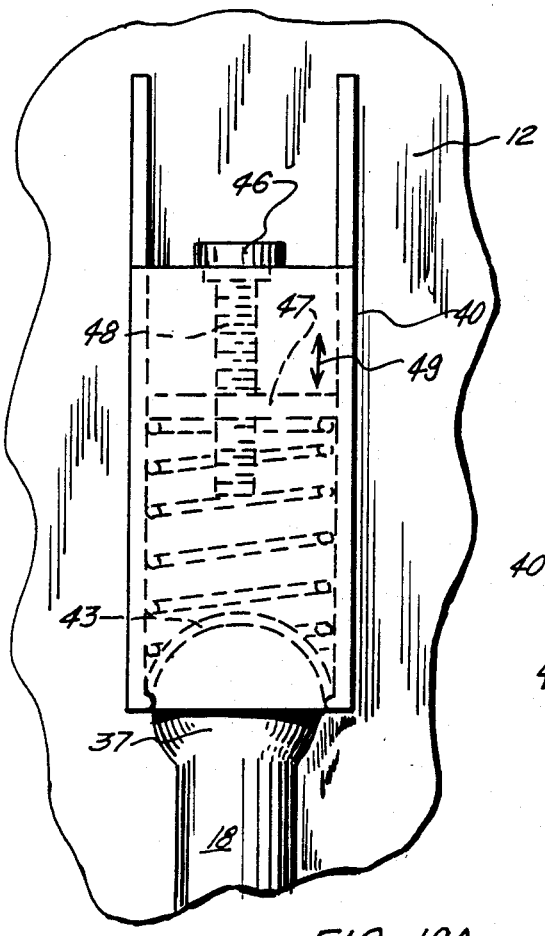
FIGS. 10A and 10B are front and side sectional fragmentary views of an alternative embodiment of the apparatus of the present invention illustrating the center connection portion thereof.
Figure 10B:
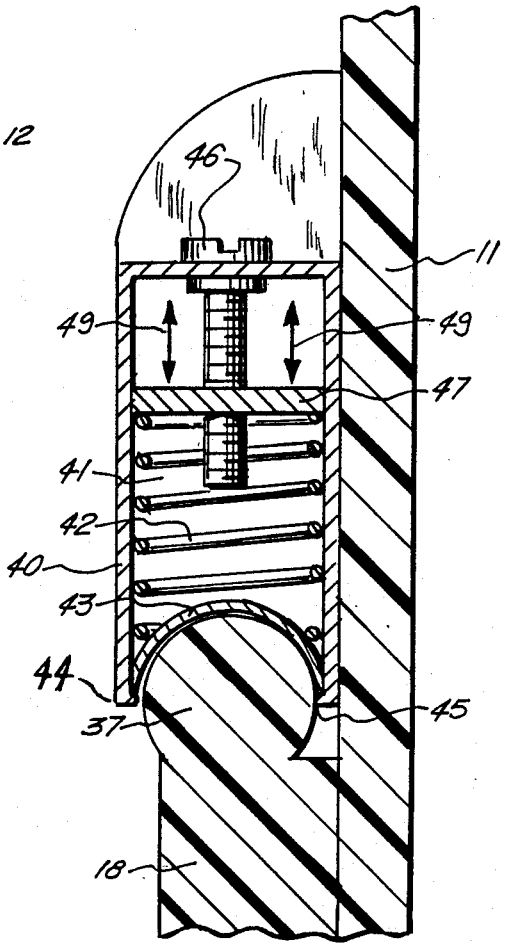

In the embodiments of FIGS. 10A and 10B, a preloaded, adjustable socket 40 is seen receptive of ball 37, the socket 40 including a bore 41 carrying a compression spring 42 that biases a curved follower plate 43 into engagement with ball 37. The lowermost end portion 44 of socket 40 provides a knurled inner edge 45 in the form of a reduced diameter area that prevents curved follower plate 43 from exiting bore 41, thus retaining it in that position. However, ball 37 also is retained within socket 40, and more particularly, occupies a position within the confines of bore 41, held in position by the knurled edge 45, as shown in FIGS. 10A and 10B. The follower plate 43 applies pressure to the ball which is adjustable by means of adjustment screw 46 and upper moveable stop 47. The stop 47 is threadably attached to threaded shaft 48 of screw 46 and one skilled in the art will recognize that rotation of the screw 46 will cause the plate 47 to move upwardly and downwardly, as shown by the direction Arrow 49 in FIG. 10A. By moving the plate 47 upwardly or downwardly, the force applied by the curved follower plate 43 to the ball 37 is varied, thus providing a preloaded value to the force applied to ball 37, thus defining a release value for ball 37 from socket 40. With players of lesser ability or younger players wherein injury might be more a problem, the socket could be preloaded with a very small release value so that a lower application of force to face mask 15 will cause the ball 37 to release from socket 40.

Figure 5:
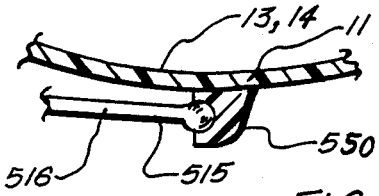
FIGS. 5–5A are fragmentary views of a fourth embodiment of the apparatus of the present invention.
Figure 5A:
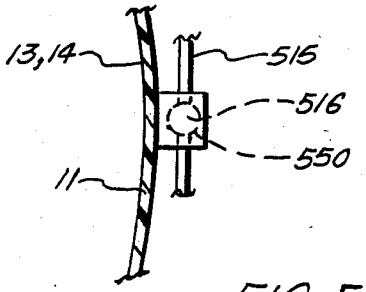
Figure 6:
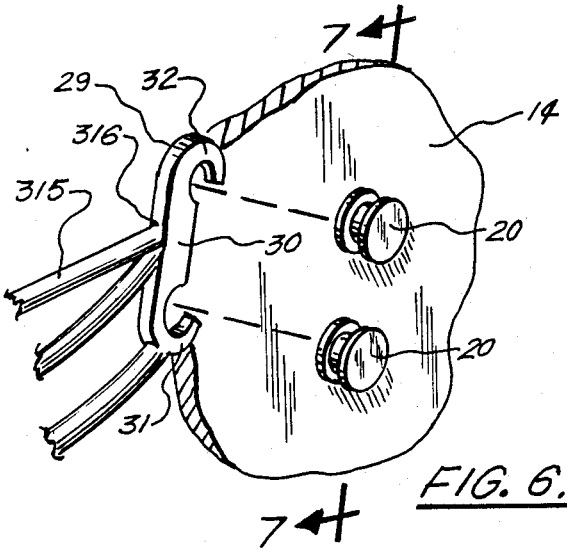
FIG. 6 is perspective fragmentary view of the third embodiment of the apparatus of the present invention illustrating the mask bracket and post portions thereof.
Figure 7:
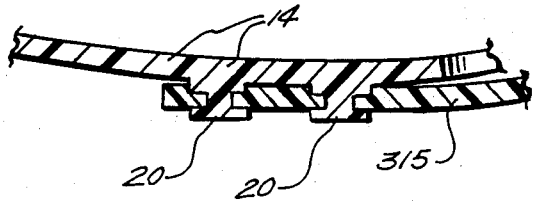
FIG. 7 is a sectional view taken along lines 7—7 of FIG. 6.
Figure 8:
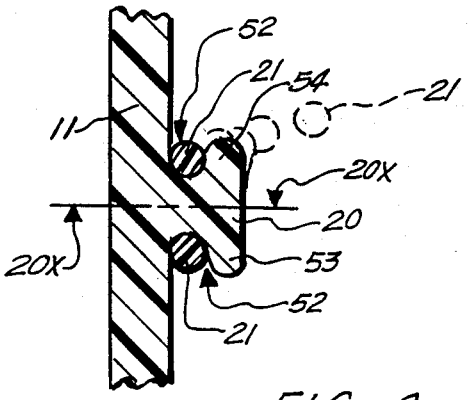
FIG. 8 is a sectional fragmentary view illustrating the post and mask portions of the preferred embodiment of the apparatus of the present invention during release of the mask from the post in a direction generally away from the helmet.
Figure 9:
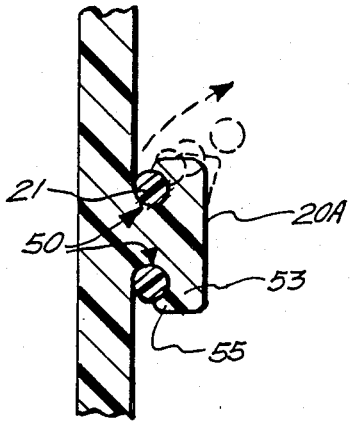
FIG. 9 is another sectional fragmentary view illustrating release of the mask from the helmet.

A similar adjustability to the release value of mask 15, 215 and 315 from helmet 11 is provided between the attachment of mask 15, 215, and 315 to helmet 11 at posts 20, and more particularly, the connection of brackets 21, 225, and 29, to posts 20. FIGS. 8 and 9 illustrate the variable release which can be made of face mask 15 to helmet 11. In FIG. 8, a single post 20 is shown as mounted upon helmet 11. The attachment of posts 20 to helmet 11 can be, for example, by gluing, an adhesive, or by screws, or as shown in FIG. 8, the posts can be integral with the helmet. The post is generally cylindrical providing a central longitudinal axis 20X, as shown in the drawings. The brackets 21 could be, for example, round in cross-section throughout the particular bracket 21 and when force is applied to the face mask 15, the brackets 21 would simply roll off the posts 20 as shown by the phantom lines in FIG. 8. Each post 20 provides a narrowed portion 50 of post 20. This is provided at the joint between post 20 and helmet 11. The narrowed portion is defined by an annular groove 52 that preferably extends 360° around post 20, as shown in FIGS. 6, 8 and 9. The narrowed portion 50 of post 20 thus defines an outer enlarged head 53 portion which can provide a rounded outer surface 54, as shown in FIG. 8. However, enlarged portion 953 can provide a downwardly extending lip 55, as shown in FIG. 9, so that the enlarged head portion 953, extends substantially around the particular bracket 21 confining it so that release of bracket 21 from post 20A is more difficult than with the configuration of FIG. 8. Further, the resiliency of post 20 could be varied so that a desired durometer reading for a particular rubber or plastic could be selected for post 20. In this manner, a more flexible material would be used for post 20 in the case of children, and less experienced athletes, or with athletes in less physical condition. Likewise, face mask brackets 21, 225, 29 could also be manufactured of a more flexible material having a flexibility which enhances release of face mask 15 from post 20. From the above, one skilled in the art will recognize that by varying the configuration of post 20 and of annular recess 52 and of enlarged head 53, and or by changing the resiliency of post 20 and or the resiliency of brackets 21, 225, 29, a broad range of release values can be achieved as desired depending upon whether the player is highly skilled or a young beginner. FIGS. 5 and 5A illustrate additional embodiments for retaining mask 515 to the side 13, 14 temple areas of helmet 11 which include a side ball and socket 550 type attachment of mask side end portions 516 to helmet 11.

In the preferred embodiment, the face mask 15 can be manufactured of any conventional structural material typically used in the manufacture of face masks, such as for example, any number of plastics (such as polycarbonate alloy) or a metal wire of round configuration covered with plastic. Similarly, helmet 11 could be manufactured of any suitable commercially available helmet material such as any a number of plastics well known in the art, including for example, polycarbonate, polycarbonate alloy, fiberglass. Posts 20 could be manufactured, for example, of hard rubber or of plastic and the posts could be manufactured integrally with the helmet, as shown in the embodiments of FIGS. 8 and 9. However, posts 20 could be retrofitted to existing helmets using attachments, such as bolted connections, screwed connections, adhesive, rivets or the like.

The foregoing description of the invention is illustrative and explanatory thereof, and various changes in the size, shape and materials, as well as in the details of the illustrated construction may be made without departing from the spirit of the invention.

What is claimed as invention is:

1. A face mask release apparatus for a rounded contact sports helmet having forehead and left and right temple areas comprising:

a. a face mask having three attachment portions including left and right side attachments adapted for placement at the left and right temple areas of the helmet and a central upper attachment generally between the left and right side attachments and adapted for attachment to the center forehead area of the helmet;

b. a plurality of posts positioned on each side of the helmet in the temple area, each post having a central axis generally perpendicular to the helmet outer surface, including a first pair of closely spaced posts placed on the left side of the helmet and a corresponding pair of closely spaced posts on the right side of the helmet;

c. a grooved area formed around each post defining a narrowed diameter section of each post generally between its end portions;

d. means carried by the face mask for forming a quick release connection of the face mask to the helmet at the posts which allows removal of the mask from the posts responsive to application of force to the mask, as during contact sports, from one or more directions including at least force which moves the mask end portion away from a post in a direction away from the helmet and generally along the central axis of the post and force applied in a direction which moves the mask in a direction away from the post in a direction along the helmet and at an angle to the post wherein the posts on each side of the helmet are positioned along a horizontal line.

2. The apparatus of claim 1 wherein the face mask has first and second side connections that each comprise a bracket that surrounds the outer opposite sides of the pair of posts on each respective side of the helmet.

3. The apparatus of claim 2 wherein each bracket is generally S-shaped.

* * * * *